United States Patent [19]

Kasprzak

[11] 3,950,916

[45] Apr. 20, 1976

[54] CEILING PANEL SUSPENSION SYSTEM CLIP

[75] Inventor: David P. Kasprzak, Largo, Fla.

[73] Assignee: The Celotex Corporation, Tampa, Fla.

[22] Filed: July 5, 1974

[21] Appl. No.: 485,830

[52] U.S. Cl. ..... 52/760; 52/758 A; 52/645; 52/664

[51] Int. Cl.[2] ..... F16B 7/04

[58] Field of Search ..... 52/760, 758 A, 753 J, 52/753 W, 645, 664, 668, 484, 489, 729, 732; 403/406, 407, 174, 178, 219, 189

[56] References Cited

UNITED STATES PATENTS

| | | | |
|---|---|---|---|
| 3,035,672 | 5/1962 | Tuten et al. | 52/484 X |
| 3,232,021 | 2/1966 | Wilson | 52/758 A |
| 3,565,473 | 2/1971 | Kedel | 52/760 |
| 3,798,865 | 3/1974 | Curtis | 52/760 X |
| 3,832,816 | 9/1974 | Jahn | 52/664 X |

*Primary Examiner*—Werner H. Schroeder
*Assistant Examiner*—Wayne L. Shedd
*Attorney, Agent, or Firm*—James W. Grace

[57] ABSTRACT

A unique clip which can be formed by the extrusion of plastic material and cut in strips can be used in a wide variety of positions to support suspension members for ceiling panels.

3 Claims, 10 Drawing Figures

CEILING PANEL SUSPENSION SYSTEM CLIP

BACKGROUND OF THE INVENTION

1. Field of the Invention

The invention is directed to a structure for supporting panels to form a ceiling in a horizontal plane.

2. Description of the Prior Art

The prior art of suspended ceilings has in general comprised a plurality of intersecting runners forming a rectangular grid in a horizontal plane. The runners are generally made in the shape of an inverted "T" with an upstanding web and outwardly extending flanges. Sound absorbing or decorative panels are held in the horizontal plane on the flanges of the runners. The ceiling can be made with panels or tiles with a large range of sizes and can be either the exposed or concealed type.

Usually the runners are held in place by wires secured to an overhead support system. Most commonly the overhead support system is a series of wooden beams. In some cases a cracked or unsightly plaster or wallboard ceiling may be used as the support means where one wishes to cover the unsightly ceiling.

Generally, the suspension runners are supported on wires which are secured to an overhead support means.

Clips of various types have been also used to support the T-shaped runners. These clips have been either metal or plastic but generally they have been designed to be used with a predetermined system and are not generally adaptable to other systems.

In addition, prior art clips lack the flexibility of providing for different distances between the ceiling and the overhead support systems. In certain applications, it is desirable to install the new ceiling very close to the existing overhead support system, particularly where the room height is rather low. On the other hand, it may be desirable to provide for a deep plenum chamber between the ceiling and the overhead support system to accommodate utility wiring of air conditioning ducts. Obviously, a universal type clip which can accommodate both constructions is highly desirable.

SUMMARY OF THE INVENTION

The invention pertains to a novel clip which is capable of being used in a wide variety of positions to support runners forming a horizontal ceiling. The clip permits the distance between the ceiling and the overhead support system to be preselected and only the proper orientation of the clip is required to accommodate different distances. The clip can be easily manufactured as an elongated extrusion of rigid plastic material which can be cut into relatively narrow strips to provide multiple clips at a very low cost.

It is an object of the present invention to provide a novel ceiling suspension clip which can be cheaply manufactured with mass production techniques.

It is another object of the present invention to provide a novel ceiling suspension clip which is versatile in that it can be used in a variety of constructions to support ceiling panels.

It is yet another object of the present invention to provide a novel ceiling suspension clip which permits easy selection of the distance between the overhead support for the ceiling and the horizontal plane in which the ceiling lies.

Other objects and advantages of the present invention will become apparent to those skilled in the art when the instant disclosure is read in conjunction with the accompanying drawing in which like numerals indicate like elements.

DESCRIPTION OF THE PREFERRED EMBODIMENTS

Figure 1:
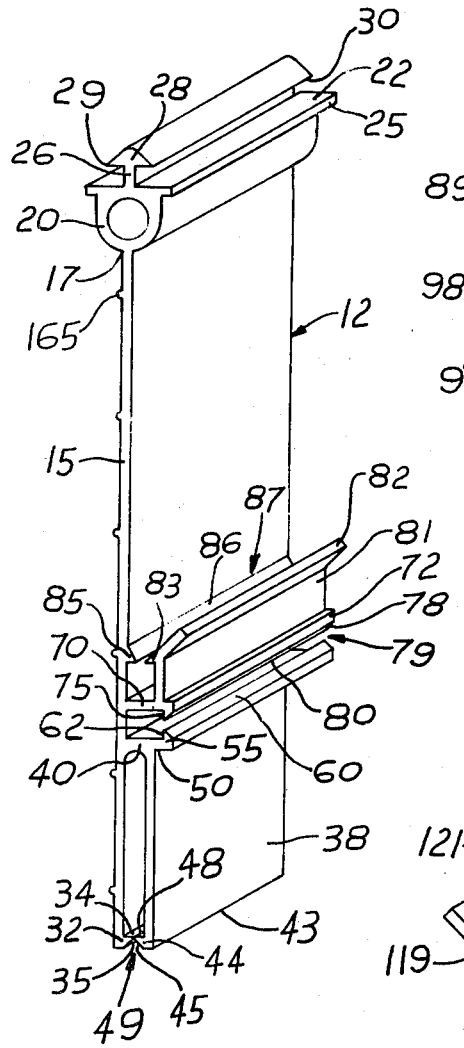
FIG. 1 is a perspective view of the clip of the invention.

With reference to FIG. 1, there is shown the novel clip 12 of the present invention. Clip 12 may be made of rigid plastic material, capable of being extruded through a die. The plastic material is preferably nylon, Teflon, polyvinyl propylene or other similar organic material. Clip 12 generally provides for a number of alternative means for securement of an overhead support and has at least three sites adapted to receive the web of the runners. Clip 12 comprises a main flat back spine 15 having an upper edge 17 terminating in an integrally formed hollow tubular section 20.

Section 20 has an elongated hole extending along edge 17 for reception of a nail or other elongated fastener.

Secured integrally along the top edge of section 20 opposite edge 17 is an inverted T-shaped structure 22 having flat flanges 24 and 25 extending outwardly of section 20 and a centrally located upstanding web 26. Web 26 has a triangularly-shaped portion 28 integrally attached longitudinally thereto and extending upwardly thereof. The apex of portion 28 faces upwardly while two lower edges 29 and 30 form gripping surfaces above flanges 24 and 25. Flanges 24 and 25 serve as stops to prevent portion 28 from being pushed too far into the clip.

At the lower edge of spine 15 is an outwardly extending flange 32 which has a flat upper surface 34 perpendicular to spine 15 and an upwardly bevelled lower face 35 meeting surface 34.

Spaced from and in a plane parallel to spine 15 is a flat strip 38 which here is shown to be about one-third the length of spine 15. Strip 38 is attached to spine 15 by web portion 40 which forms a flexible hinge to permit the lower edge 43 of strip 38 to move away from and return toward the lower flange 32 of spine 15. As with flange 32, the lower edge 43 of strip 38 has an inwardly extending flange 44 with an upwardly bevelled face 45 and a flat upper surface 48. Flanges 32 and 44 form jaws which grasp the web of one of the runners at site 49.

It should be realized that bevelled surfaces 35 and 45 act as camming surfaces so that spine 15 and strip 38 will separate at their lower edges to receive an inserted member which will be described later. Surfaces 34 and 48 are coplanar and act as retaining means for the web of a suspension runner as will become clear hereinafter.

The upper outer edge 50 of strip 38 at hinge 40 has a flange 55 extending upwardly thereof with a bevelled face 60 and a flat inner face 62 parallel to and spaced from spine 15.

A flange 70 extends outwardly from spine 15 in a plane parallel to and spaced from web portion 40. Flange 70 terminates at its free end in a downwardly extending flange 72 which has an inner flat face 75 coplanar with face 62 of strip 38 and has a bevelled face 78 intersecting flat face 75 along an edge 80 spaced slightly from the edge formed by bevelled face 60 and flat face 62 of flange 55.

Bevelled surfaces 60 of strip 38 and 78 of flange 72 act as camming surfaces to spread flanges 55 and 72 to receive the web of a runner as will be described later. Flanges 72 and 55 form jaws which are adapted to grasp the web of one of the runners at site 79.

Flange 70 also has a second flange 81 integral therewith and extending upwardly and spaced from spine 15. Flange 81 has an upwardly and outwardly extending integral lip 82 at its free end. Lip 82 is at an angle with respect to the plane of flange 81 to provide a camming surface. An internally facing flange 83 which is a continuation of the angled surface of lip 82 extends along the inner upper edge of flange 81. Acting in cooperation with flange 81 is a flange 85 integral with spine 15 and so placed as to be spaced from but in registration with flange 83 near the base of lip 82. The upper surface 86 of flange 85 is a bevelled surface to cooperate with lip 82 to receive the web of a runner and act as a cam to open the space therebetween. Flange 85 in conjunction with flange 83 form jaws which act as a locking element to hold the received web of a runner in place at site 87.

Figure 2:
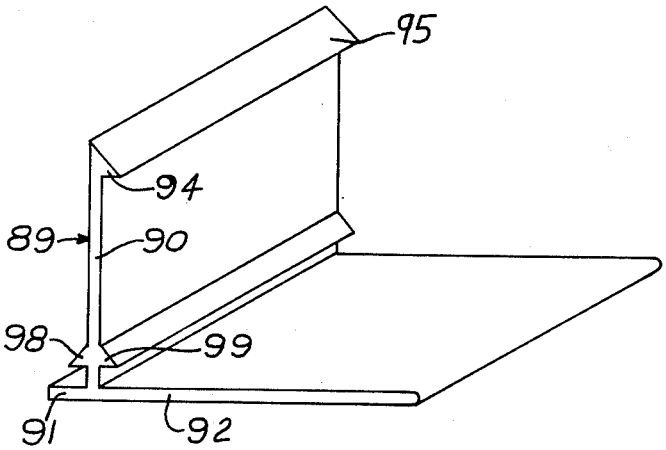
FIG. 2 is a perspective view of one type of ceiling suspension runner used with the clip of FIG. 1 and which is particularly designed to be used along a wall.
Figure 3:
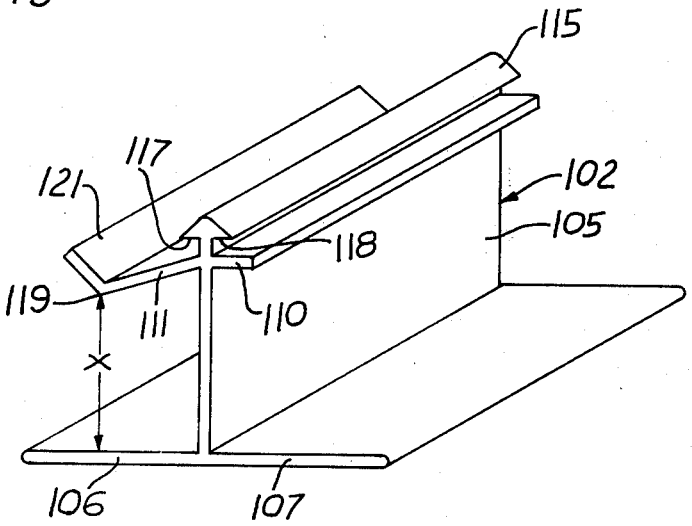
FIG. 3 is a perspective view of an alternative type of ceiling suspension runner used with the clip of FIG. 1 and which is particularly designed to be used in the field area of the ceiling.

Clip 12 is used to secure a runner, such as one of those shown in FIGS. 2 or 3, in the assembled ceiling system. The runner 89 of FIG. 2 is generally of T-shaped cross-section comprising an upright web 90 extending perpendicularly to two outwardly extending flanges 91 and 92. Because, as will become apparent later, runner 89 is used along a wall, flange 91 need only be as wide as the thickness of spine 15 plus the width of flange 32 connected thereto. Flange 92 is of much greater width than flange 91 to support a ceiling panel or tile. The upper edge of web 90 has an outwardly extending flange 94 with a downwardly bevelled surface 95, which acts as a camming surface in spreading the various securing flanges of clip 12.

Near the base of web 90 are a pair of outwardly extending flanges 98 and 99 which are spaced above flanges 91 and 92 by a distance equal to the thickness of flanges 32 and 44 so that upon insertion of runner 89 into the space between spine 15 and strip 38 the inwardly facing flanges 32 and 44 will securely hold the runner in the clip 12. Flanges 98 and 99 have downwardly bevelled upper faces to act as cams with bevelled faces 35 and 45 of flanges 32 and 44 respectively to permit entry of web 90 with the open area between the strips.

Reference to FIG. 3 shows a runner 102 which is used in the field of the ceiling. Runner 102 has a centrally located upstanding web 105 having two outwardly extending flanges 106 and 107 at right angles thereto. The upper surfaces of flange 106 and 107 serve as supporting surfaces on which ceiling tiles or panels are held in forming a horizontal ceiling.

At the upper edge of web 105 is a pair of outwardly extending flanges 110 and 111 which serve as penetration limiting elements in conjunction with a triangularly shaped locking element 115. As with runner 89, the downwardly sloping sides of element 115 act as camming surfaces and the lower edge 117 and 118 cooperate with flanges 110 and 111 to form a locking mechanism with the cooperating flanges of clip 12.

It should be noted that flange 111 has a generally V-shaped configuration in cross-section. The distance between the upper surface of flange 106 and the lowermost edge 119 of flange 111 ($x$ in FIG. 3) is selected to be slightly smaller than the thickness of the ceiling panel to be supported so that a slight gripping action is imparted to the panel to assist in assembly. The outer edge 121 of flange 111 extends upwardly so that a ceiling panel can be easily inserted between flanges 106 and 111.

Having described the various components of the ceiling suspension system as individual elements, reference may be had to FIGS. 4–10 for the alternative constructions available with the novel clip.

Figure 4:
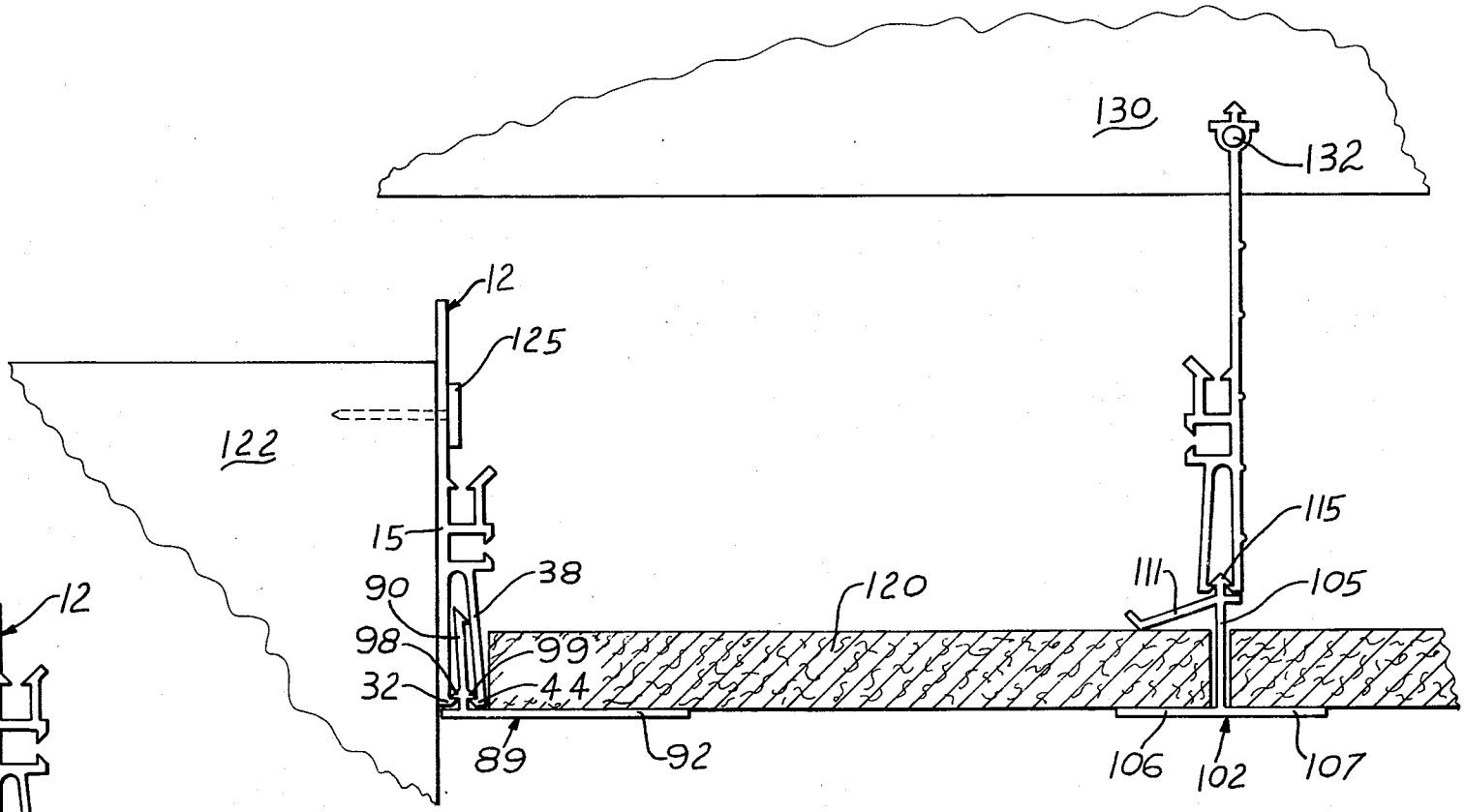
FIGS. 4–9 are end elevational views of alternative suspension system configurations using the novel clip of FIG. 1 and the runners of FIGS. 2 and 3.

FIG. 4 shows two different applications for clip 12. At the left-hand edge of FIG. 4 clip 12 is illustrated when it is used against a wall with the runner 89 of FIG. 2 used to support one edge of a ceiling panel 120. After the height of the ceiling has been determined, a mark or guide line is drawn on wall 122 and the lower edge 43 of clip 12 is aligned with the guide line. A nail or other fastener 125 is driven through the spine 15 of clip 12 to hold it to wall 122. Any length of clip 12 not required above fastener 125 can be cut off and discarded. In this configuration, runner 89 is secured to clip 12 by means of the insertion of web 90 into the hollow area between spine 15 and strip 38 of clip 12. Lower flanges 32 and 44 of clip 12 engage flanges 98 and 99 of runner 89 and hold it securely in place.

The other edge of panel 120 is supported on flange 106 of runner 102 shown in FIG. 3. As runner 102 is in the field of the ceiling, flanges 106 and 107 are of equal extension. In this configuration, runner 102 is supported from a joist or framing member 130 by means of clip 12. Clip 12 is secured to framing member 130 by means of a nail 132 or other fastener driven through the tubular hole in clip 12 in a direction perpendicular to the length of clip 12. The lower edge of clip 12 engages the upper flange 115 of web 105 by means of the grasping action of flanges 32 and 44 at site 49 of clip 12 in their engagement of flange 115. The gripping action of flange 111 of runner 102 with panel 120 is illustrated in this figure.

The position of fastener 132 in framing member 130 is determined by the height of the ceiling and a guide line can be drawn along the framing member to be used as a guide to position other clips 12. It should be realized that each of the clips 12 is of rather short width and is not a continuous strip.

Figure 5:
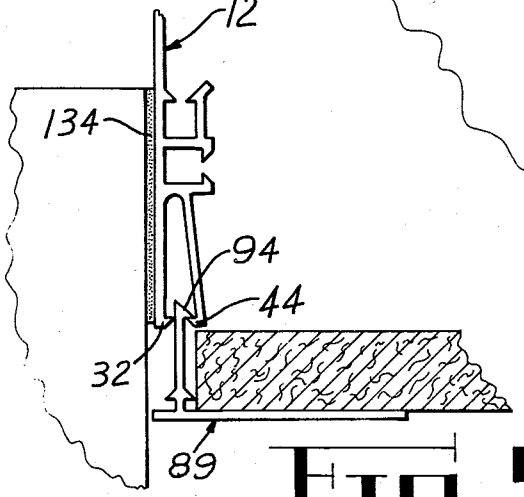

FIG. 5 shows a wall with a clip 12 secured thereto by an adhesive 134 rather than a fastener and with runner 89 suspended by its upper flange 95 rather than its lower flanges 98 and 99. In this configuration, upper flanges 94 of runner 89 is held by flanges 32 and 44 of spine 15 and strip 38 respectively of clip 12. This configuration provides a versatility to clip 12 not found in other systems.

Figure 6:
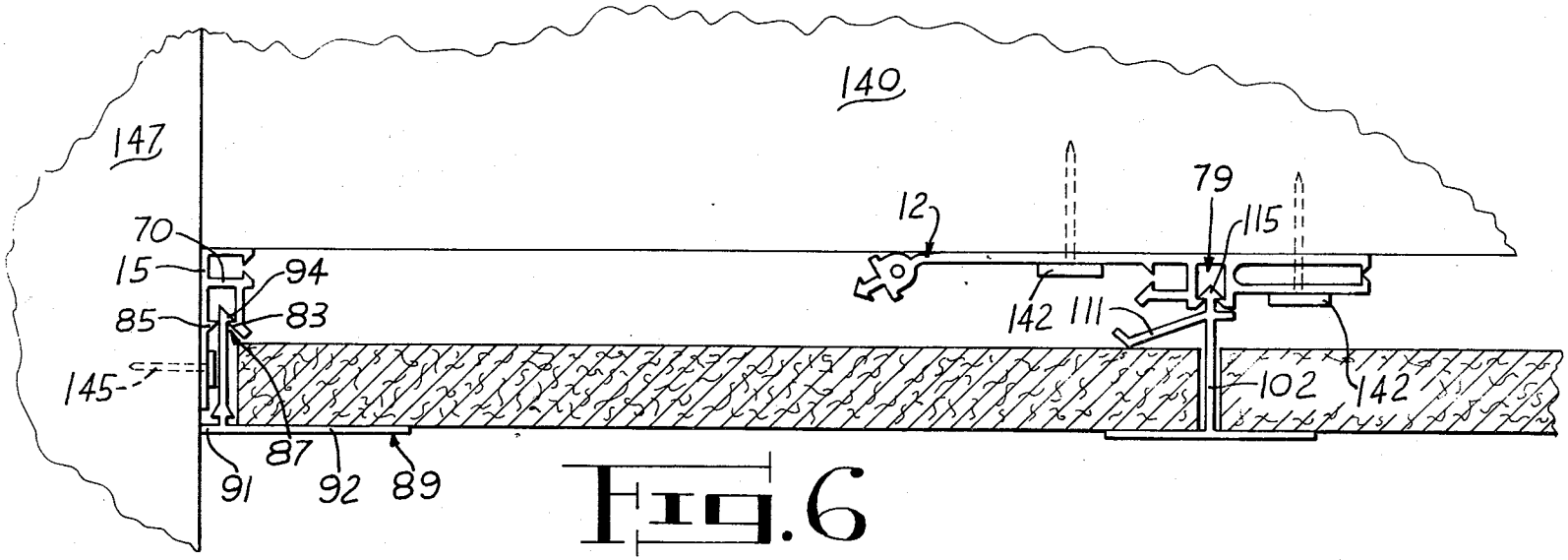

FIG. 6 illustrates an alternative use of clip 12 in which it is desired to have the horizontal ceiling very close to the overhead support 140. This variation is used where the present ceiling height is rather low and it is undesirable to lower it much further, but still provide a new ceiling.

In the configuration of FIG. 6, clip 12 is placed parallel to the underside of support 140 and secured thereto by fasteners 142. In this instance, the intermediate support structure at site 79, formed by flanges 55 of hinge portion 40 and flange 72 of flange 70, is used to grasp the top flange 115 of runner 102.

At the left-hand portion of FIG. 6, there is shown another variation of clip 12 in which the upper and lower portions are cut away leaving only the intermediate portion and providing a support for the edge runner 89. Clip 12 is placed in a position inverted with respect to that shown in FIG. 1 to use that portion of the clip designated by site 87 in cooperation with flange 94 of runner 89. A fastener 145 holds clip 12 to a wall structure 147.

Figure 7:
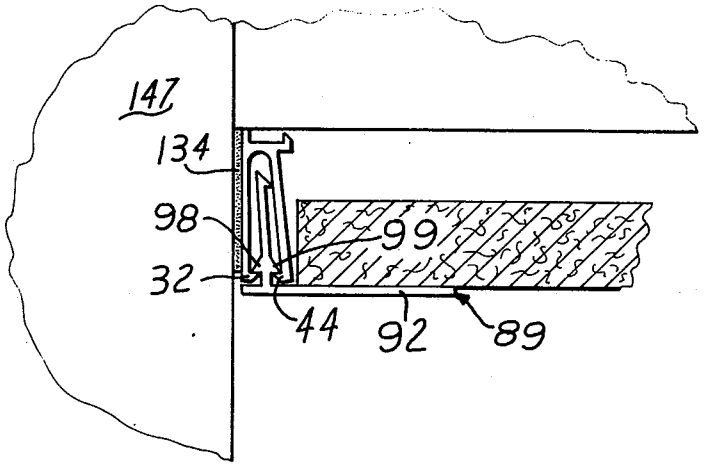

FIG. 7 shows a ceiling support structure similar to that shown in FIG. 6 for attachment of a runner to wall 147 except that the lower end of clip 12 is used in conjunction with flanges 98 and 99 of runner 89. Flanges 32 and 44 of spine 15 and strip 38 cooperate in the manner hereinbefore described to lock runner 89 into position with clip 12. Clip 12 may be adhesively secured to wall 147.

Figure 8:
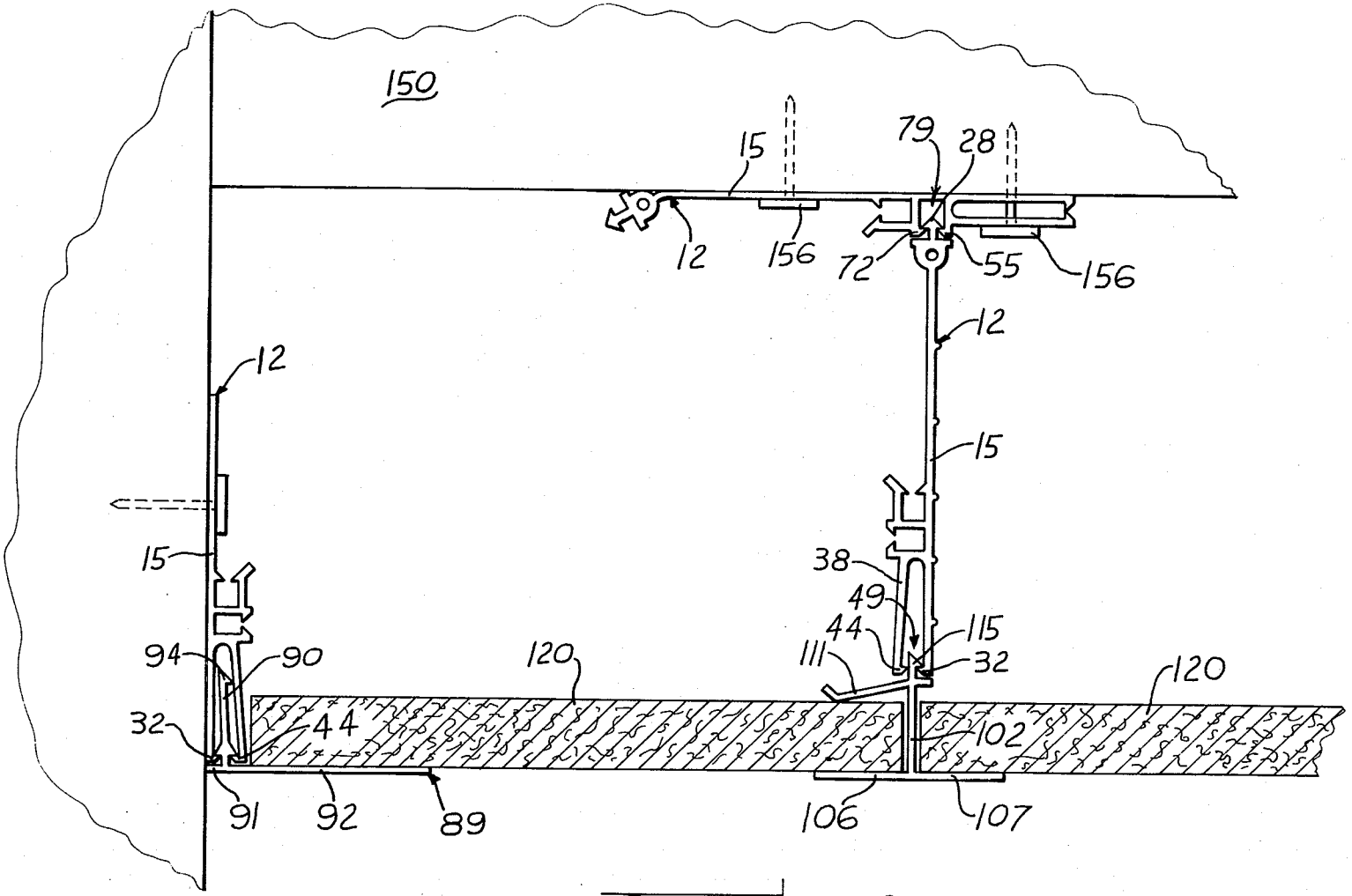

FIG. 8 illustrates another configuration showing a further variation in the use of clips 12. Here, because it is desirable to have a significant space between the overhead support 150 and the ceiling tiles 120, one of clips 12 is secured to the overhead support 150 by nails or fasteners 156. A second clip 12 has its head or top flange 28 engaging an intermediate gripping portion of the fixed clip 12 at site 79.

Field runner 102 is held in place by having its upper flange 115 engaged in the lower jaws 32 and 44 of spine 15 and strip 38 respectively at site 49.

At the left edge of FIG. 8 is shown a wall runner 89 supported by clip 12 in a manner illustrated in FIG. 4. However, clip 12 is spaced downwardly from support 150 a distance measured so that the ceiling panels are coplanar.

Figure 9:
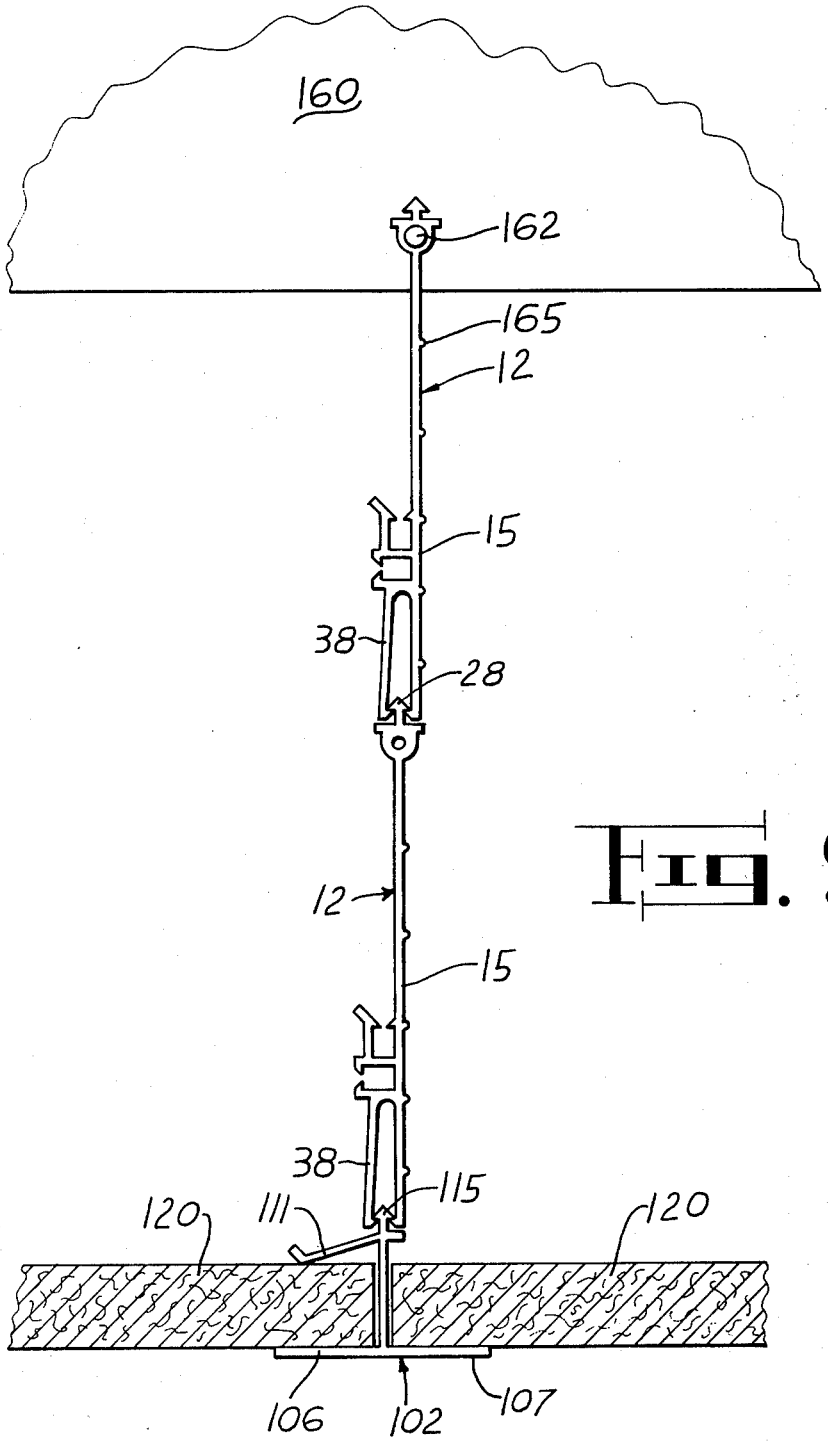

The variation in use of clips 12 in FIG. 9 is similar to that shown in FIG. 8 except that the upper clip 12 is supported from an overhead support 160 by a nail 162 driven through the tubular hole in clip 12 in the manner discussed with reference to FIG. 4. Lower clip 12 has its upper flange 28 inserted into the lower gripping end of the upper clip 12. In the manner previously discussed, field runner 102 is secured to clip 12 to support ceiling panels 120.

A series of parallel ribs 165 are spaced at a predetermined distance from each other to facilitate installation of the clips where they extend below the lower edge of a joist or framing member. The distance that the first rib of one clip 12 which is below the lower edge of the joint 160 is visually noted and it is easy to align the remaining clips 12 by visually noting the distance of a corresponding rib of each of the other clips 12 below the joist 160. Thus, the ceiling will be level without time-consuming measurements.

Figure 10:
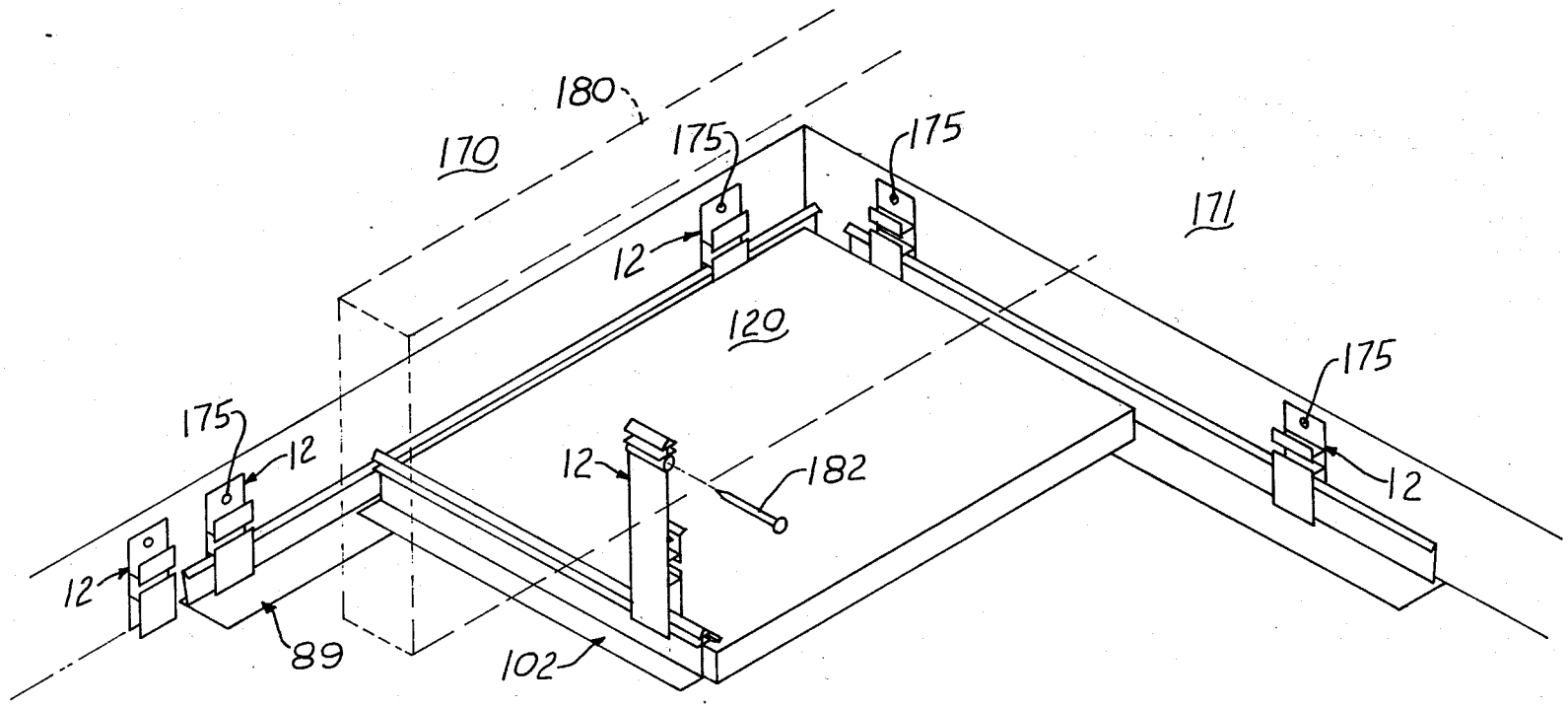
FIG. 10 is a perspective view taken above the ceiling showing a corner configuration.

FIG. 10 shows a perspective view of a ceiling panel forming a part of a horizontal ceiling being supported by wall and field runners. In this view it is clearly seen that clips 12 are narrow with respect to their length and the length of the runners. Here walls 170 and 171 serve as bases for clips 12 which are held thereagainst by fasteners 175. In the manner shown in FIGS. 5 and 8, clips 12 in FIG. 10 engage wall runners 89 which in turn support panel 120. Shown in phantom outline is a joist or framing member 180 to which field clip 12 is fastened by a nail 182.

In summary there is herein shown and described a novel clip for supporting a ceiling suspension system which is versatile in application, economical to manufacture and simple to install.

I claim:

1. In a ceiling panel support system in which there are support clips for direct attachment to a building member, said clips being affixable in a variety of orientations to support inverted T-shaped runners having upstanding webs, and at least one integral, longitudinal flange on said web, the improvement in which said clip comprises:

a generally planar, resilient member having a length greater than its width and being relatively thin with respect to either of its other dimensions, said planar member having a male connecting means on one end generally coplanar with the plane of said planar member, said planar member further having a female connecting means at its end opposite said male connecting means, said female connecting means comprising three female receptacles, each of said three female receptacles being on the same side of said planar member, a wall of said planar member forming one side of each receptacle, each of said female receptacles having spaced parallel sidewalls, the spaced sidewalls of each of said receptacles defining a plane of entrance intermediate and parallel to the said sidewalls defining each receptacle, each of said receptacles being arranged along said planar member sequentially from the end opposite said male member, the planes of entrance of the two end female receptacles being substantially parallel to the axial plane of said coplanar member, the plane of entrance of said intermediate female receptacle being substantially perpendicular to said axial plane of said coplanar member, and retention means extending inwardly from the sidewalls defining each said receptacle, said retention means of each female receptacle being adapted to grasp said longitudinal flange on said web or said male connecting means of another clip.

2. In a ceiling panel support system as recited in claim 1, the improvement in which said one of said end receptacles most remote from said male connecting means has a depth substantially equal to the height of the web of one of said runners.

3. In a ceiling panel support system as recited in claim 1, in which said clip has a hollow tubular member intermediate said male connecting means and said female connecting means, said hollow tubular member having its major axis perpendicular to the planar major axis of said planar member.

* * * * *

UNITED STATES PATENT OFFICE

CERTIFICATE OF CORRECTION

PATENT NO. : 3,950,916

DATED : April 20, 1976

INVENTOR(S) : David P. Kasprzak

It is certified that error appears in the above-identified patent and that said Letters Patent are hereby corrected as shown below:

Claim 3, line 5, delete "planar".

Signed and Sealed this

Twentieth Day of July 1976

[SEAL]

*Attest:*

RUTH C. MASON
*Attesting Officer*

C. MARSHALL DANN
*Commissioner of Patents and Trademarks*